United States Patent [19]

Chermack

[11] 4,008,740

[45] Feb. 22, 1977

[54] DISPENSING APPARATUS FOR FILLING DRINKING CONTAINERS

[76] Inventor: Robert W. Chermack, 14424 Spring Lake Road, Hopkins, Minn. 55343

[22] Filed: Sept. 3, 1974

[21] Appl. No.: 502,974

[52] U.S. Cl. ..... 141/100; 222/280; 241/235; 241/DIG. 17; 241/100

[51] Int. Cl.[2] ..... B65B 1/04; B02C 13/20

[58] Field of Search ..... 141/9, 82, 98, 100, 141/104, 105, 106, 234, 237–245, 351; 222/80, 280, 281; 241/DIG. 17, 101.2, 235; 251/212

[56] References Cited

UNITED STATES PATENTS

| | | | |
|---|---|---|---|
| 1,170,046 | 2/1916 | Carleton | 251/212 X |
| 1,560,313 | 11/1925 | Pittman | 222/281 |
| 1,709,770 | 4/1929 | Brady | 141/242 |
| 1,846,827 | 2/1932 | Ayars | 141/234 |
| 3,580,304 | 5/1971 | Chermack | 141/244 |

FOREIGN PATENTS OR APPLICATIONS

| | | | |
|---|---|---|---|
| 1,055,606 | 5/1952 | France | 251/212 |

*Primary Examiner*—Richard E. Aegerter
*Assistant Examiner*—Frederick R. Schmidt
*Attorney, Agent, or Firm*—Williamson, Bains & Moore

[57] ABSTRACT

A dispensing apparatus for filling a plurality of drinking containers positioned in predetermined locations on a tray dispenses ice, water, or both. The apparatus has a storage hopper for containing a supply of ice, the hopper having a discharge opening at the bottom which communicates with a gate for controlling the flow of ice from the discharge opening. A plurality of generally upright chutes is positioned below the gate and extends from the gate to a receiving chamber near the base of the apparatus. The tray and drinking containers are positioned in the chamber and receive ice from the chutes, the outlet of each chute being positioned over one of the drinking containers. Ice flow from the hopper to the chutes is selectively arrested by the gate which includes a plurality of rigid, elongated members, all of which are disposed in side-by-side relationship with their longitudinal axes being parallel. The members are mounted for simultaneous rotation about their longitudinal axes to swing between a closed position where the members cooperate to form a barrier across the discharge opening, and a discharge position where ice may pass freely between the longitudinal members and into the chutes. Each longitudinal member has an ice-retaining web which confronts the discharge opening of the hopper when in closed position, and when in open position confronts the web of an adjacent member to define ice discharge slots between adjacent elongated members between which ice may pass downwardly to the chutes. Each member is provided with ice-breaking means positioned thereon to swing against the ice supply during rotation of the elongated member to thereby loosen ice from the supply and cause ice discharge from the hopper. A water manifold may be positioned within the receiving chamber and connected to a supply of water to selectively dispense water into the drinking containers, it being preferred that the manifold be positioned between the chutes and above the level of the outlets of the chutes.

5 Claims, 6 Drawing Figures

DISPENSING APPARATUS FOR FILLING DRINKING CONTAINERS

BACKGROUND OF THE INVENTION

Most restaurants, hospitals and large institutions maintain kitchens and dining facilities capable of serving meals to hundreds of persons per day. Among the services provided by such facilities is the providing of a container of ice water for each diner. In the past, the hundreds of glasses of ice water required for each day's service have often been prepared and filled entirely by hand labor of waitresses or assistants who pour a measured amount of ice into each glass and then fill each glass with water from a standard tap. Where many glasses of ice water must be prepared, one or more employees can use substantially their full working day in filling glasses. Ice making and dispensing machines have been developed for the filling of a single glass, but even with the help of such a machine the task remains very laborious.

The invention of a water dispenser for filling a plurality of glasses simultaneously, as disclosed in U.S. Pat. No. 3,580,304 by Robert W. Chermacka has been of substantial help in reducing the burden of filling large numbers of glasses with water, but the task of filling them with an appropriate quantity of ice has up to now been a tedious one.

While it is highly desirable to have a dispensing apparatus which can fill a plurality of glasses simultaneously with ice, the only available apparatuses fill only single glasses. Typically, the apparatuses are often unreliable and prone to break down. Most such apparatuses are designed to function only when a supply of finely crushed ice is available. The ideal temperature conditions required to keep crushed ice from congealing into a frozen, solid mass are difficult to maintain, and almost invariably a supply of crushed ice does freeze and the previously available apparatuses become inoperative. Some apparatuses have attempted to maintain a supply of crushed ice in particulated, uncongealed form by continually agitating the ice, but such methods have been only marginally successful. Another problem which has remained unsolved up to now by the available ice dispensing machines is that because of the tendency of crushed ice to congeal and form a solid mass, the bits and pieces of ice which are dispensed from the prior art machines are irregular in size, and sometimes are large enough to cause jamming of the machine. Even if not so large as to jam the machine, oversize chunks of ice do cause substantial splashing when they fall into the filled water glasses, thereby creating clean-up problems and further inconvenience. The present invention is designed to meet and overcome these difficulties and provide a dispensing apparatus able to meet the high demands of the commercial restaurant or other facility where exceptional reliability and low rate of failure are essential.

SUMMARY OF THE INVENTION

The invention relates to the field of dispensing devices and dispenses ice, water, or both into a plurality of drinking containers, thereby rapidly filling a large number of glasses and eliminating a time-consuming, tedious job previously done primarily by hand labor.

The dispensing apparatus utilizes a hopper for storing a supply of ice, a discharge opening being formed in the bottom of the hopper and communicating directly with gate means which selectively opens and closes to control ice flow from the hopper. A plurality of generally upright chutes is grouped in an array and positioned below the gate means to receive ice passing through the gate and direct the ice downwardly through the chutes into the drinking containers, a container being located below each of the chutes in a receiving chamber at the base of the apparatus. The inlet at the top of each chute is substantially larger than the outlet at the bottom of the chute and the sidewalls of the individual chutes are tapered inwardly so that ice falling downwardly from the gate and into the chute strikes the sidewalls, ricocheting inwardly to strike other ice particles, the interception by the wall and the ricocheting effect within the chute tending to further break up the ice into smaller ice particles before discharging the ice into the drinking containers.

The gate means used with the invention includes a plurality of rigid, elongated members, all of which are disposed in side-by-side relationship with each other with the longitudinal axes of the members being parallel. Each longitudinal member is provided with an ice-retaining web extending longitudinally along the member and the individual elongated members are mounted for rotation about their longitudinal axes to swing between a closed position, wherein the ice-retaining web of each member confronts the discharge opening of the hopper and is closely adjacent the ice-retaining web of at least one adjacent elongated member so the ice-retaining webs of the elongated members cooperate to define a barrier across the discharge opening, and a discharge position, wherein the web of each member confronts the web of an adjacent member to define ice discharge slots between adjacent elongated members through which ice may pass downwardly into the chutes.

One substantial advantage of the invention is that each elongated member may be provided with ice-breaking means so that as the elongated members are rotated about their longitudinal axes the ice-breaking means engages and contacts the ice supply to break ice therefrom and cause downward discharge through the gate. The disclosed ice-breaking means works equally well whether the supply of ice is a quantity of crushed ice or whether the supply is a large integral block of ice. Preferably the elongated members are formed of rigid metal tubes from which at least one longitudinal section has been removed to form an open-faced trough. The pair of longitudinal edges along the trough forms the ice-breaking means and is effective in breaking ice from even large, solid blocks of ice.

Gate operating means is mounted on the gate and mechanically rotates each of the elongated members about its longitudinal axis, producing simultaneous rotation of all the members.

A water manifold may be positioned below the chutes and above a receiving chamber into which the plurality of drinking containers is placed for filling. The water manifold is provided with means for connecting it to a water source and has a plurality of nozzles, each nozzle being aimed into the open top of a drinking container within the receiving chamber. The basic operating principles of the water manifold and the nozzles used with it are discussed in further detail in U.S. Pat. No. 3,580,304 entitled "Glass Filler," by Robert W. Chermack, patented May 25, 1971.

The dispensing apparatus is extremely reliable, long lasting, and inexpensive to manufacture. It provides a device by which a large number of glasses may be simultaneously filled with ice and water with minimal expenditure of human labor. The device makes possible the filling of glasses in a small fraction of the time required previously, and accordingly is of very substantial value to restaurants, large kitchens and institutions where great numbers of glasses must be filled each day.

These and other advantages of the invention will appear from the appended drawings and the following more detailed description.

DESCRIPTION OF THE PREFERRED EMBODIMENT

Figure 1:
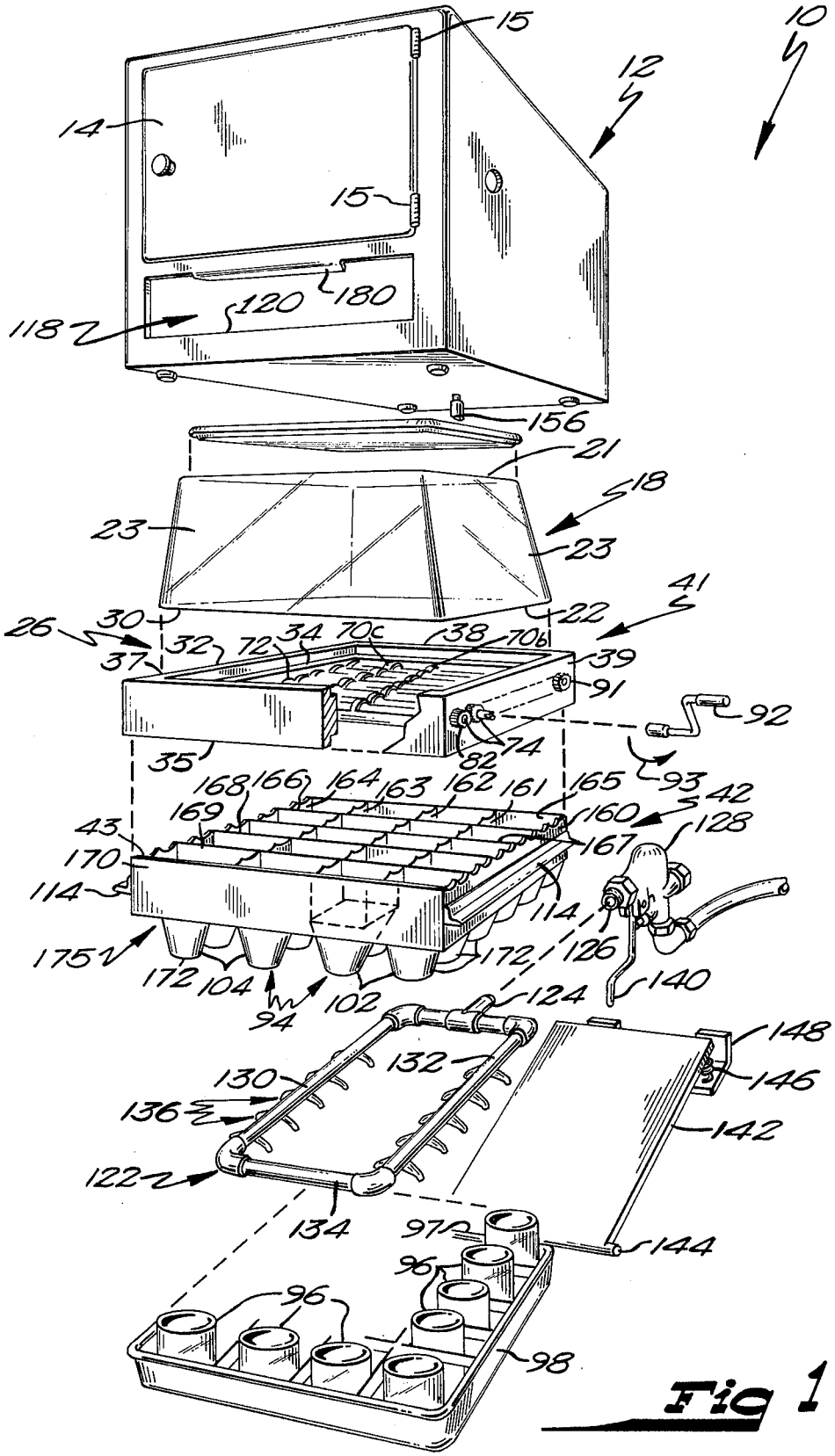
FIG. 1 is an exploded perspective view of an embodiment of the dispensing apparatus invention.
Figure 2:
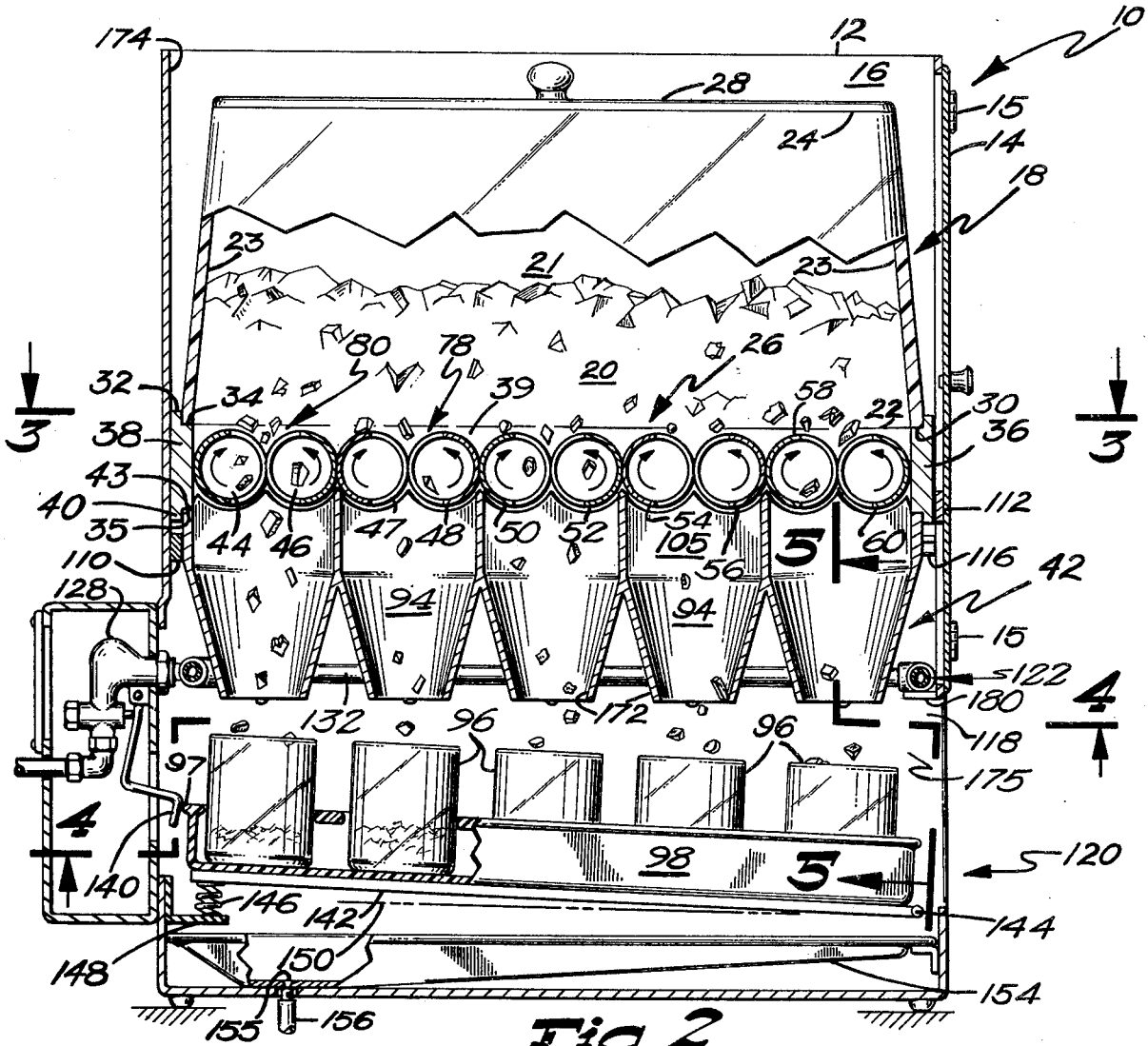
FIG. 2 is a side, cross-sectional view of the embodiment shown in FIG. 1.
Figure 3:
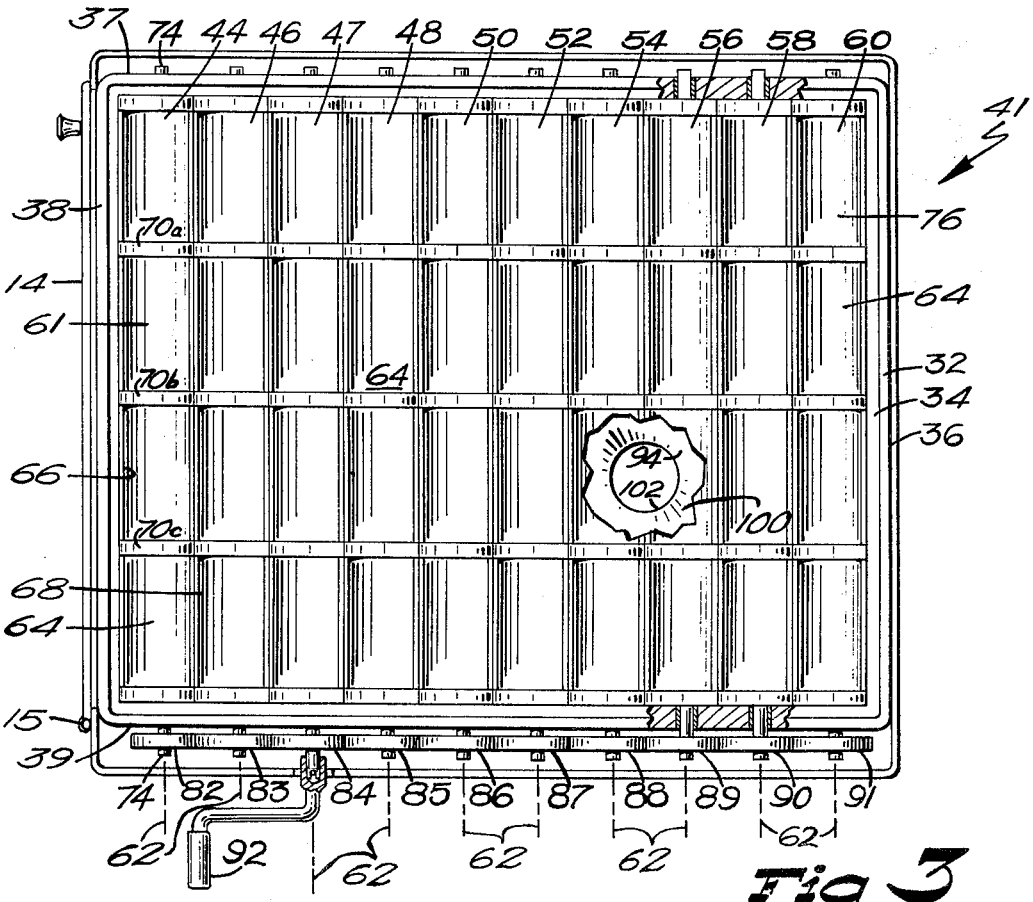
FIG. 3 is a top elevation view of the gate means used with the invention and taken along cutting plane 3—3 of FIG. 2.

Referring now to FIGS. 1–3, the dispensing apparatus 10 embodying the invention has an outer protective case 12 formed of stainless steel or other appropriate material acceptable to the restaurant or institutional trade, the case having a door 14 swingably connected to the case by hinges 15 at the front thereof to provide easy access into the inner cavity 16 of the case. A latch (not shown) releasably retains the door 14 in the closed condition of FIG. 3.

Within the inner cavity 16 of case 12 is a storage hooper 18 capable of storing a supply of ice 20 in the interior 21 thereof, the hopper having a discharge opening 22 at the bottom thereof and occupying substantially the entire bottom of the hopper 18. A loading opening 24 is located at the top of the hopper, permitting insertion of ice therethrough in order to reload the hopper. The loading opening 24 is of a smaller cross-sectional area than is discharge opening 22 because the hopper walls 23 are tapered outwardly from top to bottom so that the ice supply 20 within the hopper will not wedge against the walls and will instead drop downwardly toward the discharge opening 22 and contact the gate means 26 which will be described hereafter. The hopper 18 may be formed of any material which is easily cleaned and long lasting, it being preferred that it be formed of stainless steel, which has obtained wide acceptance in the restaurant trade. If desired, a lid 28 may be positioned over the loading opening 24 of the hopper 18 to further insulate the ice 20 from ambient air and thereby retard melting. If desired, the inner cavity 16 of the case may be provided with refrigeration means to prevent melting of the ice. A solid block of ice or alternatively crushed ice of any convenient size may be used in the hopper, and the invention functions effectively with either.

The hopper 18 is preferably of generally square or rectangular cross section as viewed from above to conveniently fill the interior of the cavity 16 but still allow adequate head room to permit loading of the hopper. The hopper 18 has its lower rim 30 supported upon the ledge 34 of gate means 26 with the rim 30 being matably received within upstanding lip 32 which extends about the gate means 26, as best shown in FIG. 3, to contain the rim 30 in the shown position of FIG. 2. To remove the hopper for cleaning, an operator need only lift it upwardly from its nested position on the gate means 26.

The gate means 26 has sidewalls 36, 37, 38 and 39 which are rigidly joined at their corner intersections to define a generally rectangular frame 41 which directly receives rim 30 of the hopper 18 on ledge 34. Each of the sidewalls 36, 37, 38 and 39 is provided with a downwardly extending lip 40 running entirely about the rectangular frame 41 to permit the lower ledge 35 of frame 41 to nest on the upper rim 43 of the delivery means 42, formed of a plurality of chutes and described hereafter.

Referring now to FIG. 3, a plurality of substantially identical rigid, elongated members or elements 44, 46, 47, 48, 50, 52, 54, 56, 58 and 60 are disposed in side-by-side relationship with each other with the longitudinal axes 62 of the members being mutually parallel and in a common plane. Because all of the elongated members are substantially identical, only the structure of the elongated member 44 will be described in detail, but it should be understood that the description of the member 44 is equally applicable to the members 46, 47, 48, 50, 52, 54, 56, 58 or 60.

Figure 6:
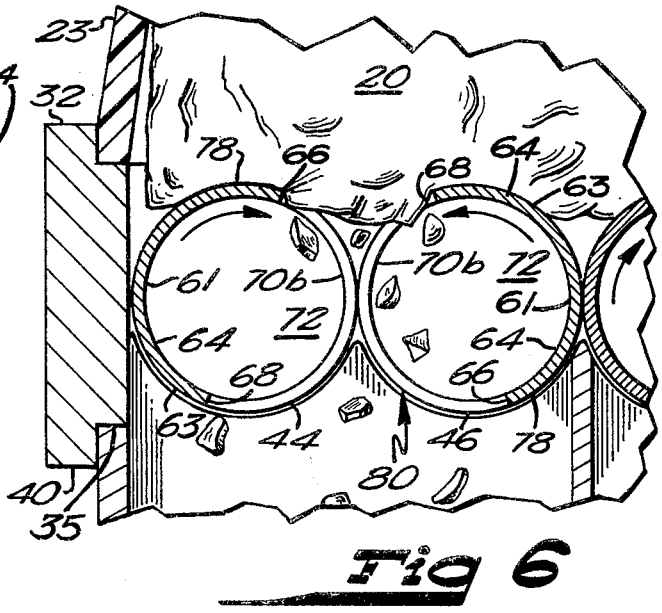
FIG. 6 is a sectional, side elevation view showing the elongated members of the gate means breaking ice from the ice supply.

Elongated member 44 is of generally trough-like, arcuate cross section with a generally open top, it being preferred that the inner periphery 61 and outer periphery 63 (FIG. 6) of the member be of generally semi-circular cross section, although arcuate cross sections other than a semicircle are effective with the invention. This semicircular shape forms an ice-retaining web 64 which is extremely effective in preventing the downward falling of ice from the hopper 18 to the delivery means 42 when the ice-retaining webs 64 of the elongated members are in the closed position 76 shown in FIG. 3, in which the members cooperate to form a barrier across the discharge opening 22. The opposed longitudinal edges of the ice-retaining web 64 of member 44, namely edges 66 and 68 (FIG. 3), comprise ice-breaking means and are extremely efficient in breaking ice from the supply of ice 20 when the elongated member 44 is rotated about its longitudinal axis 62 to cause one of the longitudinal edges to engage the ice as best illustrated in FIG. 6 and described further hereafter.

Each elongated member, such as member 44, has semicircular bands **70*a*, 70*b* and 70*c* connected with and extending from the semicircular outer periphery 63 of the ice-retaining webs 64 and spaced apart along the member, the bands having the same center and radius of curvature as the outer periphery 63 of the ice-retaining web 64. These bands provide additional strength and reinforcement to the elongated member when it is rotated about its longitudinal axis and the edges 66 and 68 used for breaking the ice 20. Although five bands have been shown in the embodiment 10, it should be understood that a greater or lesser number could be used and is within the purview of the invention. A circular plug or end cap 72 is rigidly fixed to the opposed ends of each elongated member and oriented perpendicularly to the axis 62. Each of these caps 72 has a shaft 74 positioned on the axis 62 of the member and extending outwardly therealong and rigidly fixed relative to the member. Each of the shafts 74 is rotatably mounted or journaled in the opposed sidewalls 37 and 39 for rotation about the axis 62.**

Accordingly, the elongated members 44, 46, 47, 48, 50, 52, 54, 56, 58 and 60, all substantially identical, are mounted to the opposed sidewalls 37 and 39 for rotation about their longitudinal axes 62 for rotational movement between a closed position 76 shown in FIG. 3, wherein the ice-retaining webs 64 of the members cooperate to form a barrier across the discharge opening 22, obstructing ice flow past the members, and a discharge position 78 (FIG. 6), wherein the ice-retaining web 64 of each member, such as member 44, confronts the web of an adjacent member 46 to define ice discharge slots 80 between adjacent elongated members, permitting ice flow from the hopper 18 downwardly through the discharge slots 80 to the chutes of the delivery means 42. The ice-retaining web 64, longitudinal edges 66 and 68, bands 70*a*, 70*b* and 70*c* and end caps 72 with their extending shafts 74 collectively comprise the elongated member or element 44, whose structure is typical of the elongated members disclosed herein.

It has been found effective to form each elongated member from a rigid, round section tube whose ends are capped with plugs or caps 72, one or more longitudinal sections being cut from the tube to give it its troughlike, arcuate cross section. Preferably each section cut from the tube would extend laterally between the edges 66 and 68 and longitudinally between a cap 72 and the nearest band 70*c* or alternatively longitudinally between a pair of bands such as 70*c* and 70*b*. On the member 44, four longitudinal sections would be removed to provide the shown configuration of FIG. 2. Accordingly, the plurality of elongated members with their bands, end caps and extending shafts along with the rectangular frame 41 collectively comprise the gate means 26 which is positioned in blocking relationship with the discharge opening 22 of the hopper 18 as best shown in FIG. 2.

Identical spur gears 82, 83, 84, 85, 86, 87, 88, 89, 90 and 91 are fixed to the axially extending shaft 74 of the elongated members 44, 46, 47, 48, 50, 52, 54, 56, 58 and 60, respectively, for rotation with the shafts 74, resulting in movement of an elongated member when its axially attached spur gear rotates. All of the described spur gears 82–91 are arranged in meshing, engaged relationship with one another along the sidewall of the gate means 26, and accordingly rotation of any one of the spur gears will cause identical rotation of the remaining spur gears, and consequently, rotation of one elongated member results in simultaneous rotation of the remaining elongated members about their longitudinal axes 62. A means for manually rotating one of the spur gears is provided in the form of hand crank 92 which is shown fixed to spur gear 84, so that rotation of the crank 92 will rotate spur gear 84, causing rotation of all the elongated members. While the spur gears 82–91 and crank 92 have been shown as attached to the shafts 74 of the elongated members along a particular sidewall 39 of the frame 41, it should be understood that the spur gears and crank could as readily have been positioned along the opposed sidewall 37. The recited spur gears 82–91 and hand crank 92 collectively comprise gate opening means mechanically connected to the elongated members for simultaneously rotating all of the elongated members about their longitudinal axes 62 when the crank is actuated by an operator. While a crank has been shown herein, it should be understood that it may be replaced by an electric motor or other driving means if desired, and such alternatives are within the purview of the invention. When the hand crank 92 is rotated in a direction 93, as indicated in FIG. 1, the elongated members rotate as indicated by the arrows in FIG. 2.

Each two adjacent elongated members, such as members 44 and 46, 47 and 48, 50 and 52, 54 and 56, and 58 and 60, cooperate with one another to break ice from the supply of ice 20 positioned above the gate 26 in the hopper 18. When the directions of rotation of the members are as illustrated in FIGS. 2 and 6, the elongated member 44 is turning clockwise and the member 46 is turning counter-clockwise. The movement results in the longitudinal edges 66 and 68 of the members 44 and 46, respectively, moving toward one another, as best shown in FIG. 6, to catch the ice between them and shave or break it from the block 20. An identical cooperation occurs between the remaining adjacent members 47 and 48, 50 and 52, 54 and 56, and 58 and 60.

It has generally been found adequate to rotate the elongated members through an arc of approximately 90° between the closed position 76 and the discharge position 78, although this may be increased or decreased by the operator to generate the amount of ice discharge needed. To return the elongated members to closed position, the operator simply swings the crank 92 rearwardly to its starting position. Accordingly, the gate operating means mechanically interconnects the elongated members and simultaneously rotates all of the members about their axes when the crank 92 is actuated by the operator.

Figure 4:
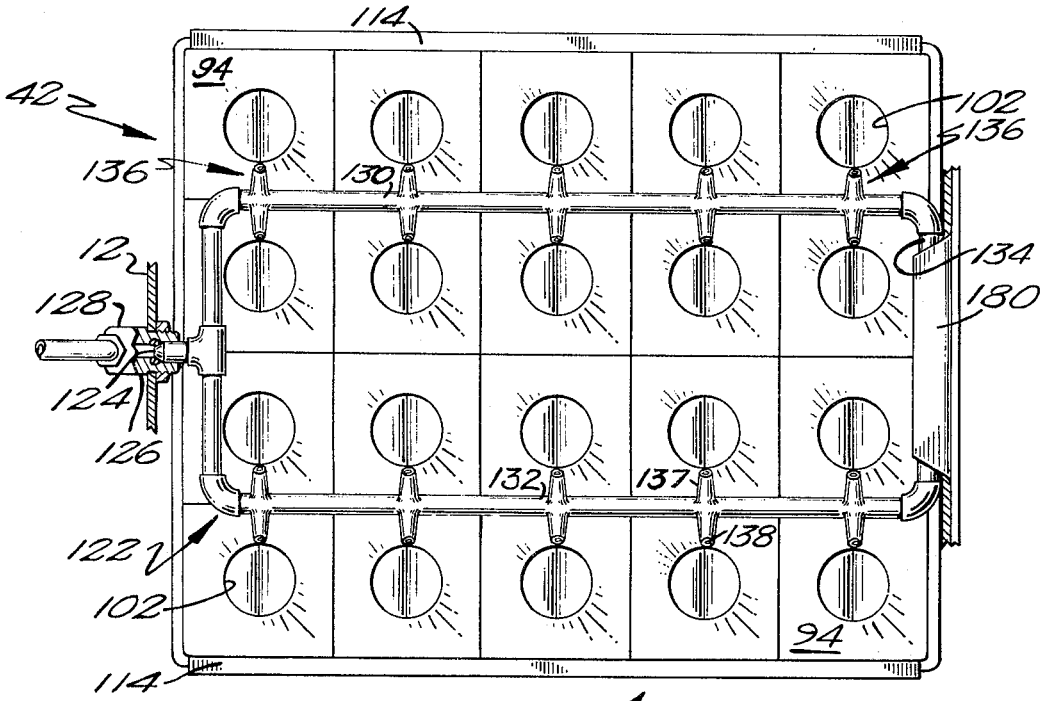
FIG. 4 is a bottom view of the chutes and water manifold of the invention taken along cutting plane 4—4 of FIG. 2.

An array of chutes 94 is positioned closely adjacent one another below the gate means 26 and arranged in parallel rows, as best shown in FIG. 4, where the particular shown array has four rows with five chutes 94 in each column. These chutes may be formed of any acceptable long lasting, easily cleaned material such as stainless steel and are rigidly joined together to form a plurality of longitudinal dividers 160, 161, 162, 163, and 164 extending from front to rear of the array and intersected by lateral dividers 165, 166, 167, 168, 169 and 170 to form a plurality of generally rectangular cross section inlets 100 for receiving ice from the gate 26.

Figure 5:
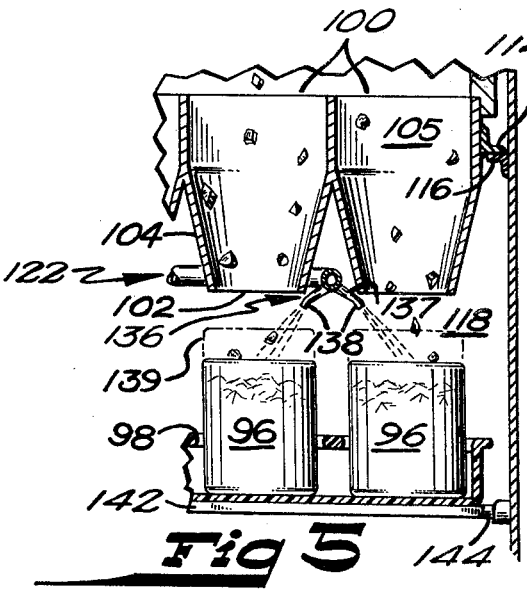
FIG. 5 is a sectional, front elevation view of the embodiment of FIG. 1, taken along cutting plane 5—5 of FIG. 2, showing ice and water being dispensed into two of the drinking containers.

Because all of the chutes 94 are substantially identical, only one will be described in detail. Each chute 94 has the generally square cross section inlet 100 (FIG. 3) adjacent gate 26 and a substantially smaller, generally circular, cross section outlet 102 positioned over a container 96 in the receiving chamber 118. The square cross section of each chute defined by the lateral and longitudinal dividers extends throughout untapered portion 105 of each chute and the chute then has tapered sidewalls 104 tapering inwardly and terminating at the outlet 102. Each inlet 100 is approximately centered on and positioned directly below the longitudinal slot 80 between adjacent cooperating elongated members when the members swing to the discharge position 78 illustrated in FIGS. 2 and 6. Accordingly, when the elongated members are in the discharge position 78, ice flows through the discharge slots 80 downwardly into the inlet 100 of chute 94, and after gaining velocity during its fall through untapered portion 105 strikes the inwardly tapered sidewalls 104 of tapered portion 172 as best shown in FIG. 5, thereby causing the falling ice particles to ricochet inwardly from the tapered wall 104 to strike the wall again or to strike other falling chips therebetween, resulting in agitation of the ice and causing the ice to break into smaller pieces. The ice agitation within the tapered sidewalls 104 of each chute 94 also causes the ice to drop more slowly from the outlet 102 of each chute into the container 96 therebelow, thereby minimizing splashing when the container is filled with water.

Preferably, the array 175 of chutes 94 is formed as an integral group of chutes as shown, permitting the entire array 175 to be easily inserted and removed as a unit from the case 12 for easy cleaning.

The lower lip 40 of the rectangular frame of the delivery means 26 nests about the upper rim 43 of the array 175 (FIG. 2), the rectangular frame 41 of the gate being supported on the outer, generally rectangular structure formed by intersecting dividers 165, 164, 170 and 160.

A stop 110 (FIG. 2) is attached to the rear wall 174 of the case 12 and extends forwardly to limit rearward travel of the array of chutes, so that it may be maintained in a predetermined position relative to the drinking containers 96 positioned therebelow on tray 98. An additional spacer 112 is provided at the front end of the chute array 175 and contacts the hinged door 14, which urges the spacer 112 and array 175 rearwardly into contact with stop 110 to retain the array in the preferred orientation above the drinking containers 96.

The longitudinal dividers 160 and 164 of array 175 each have an outwardly extending flange 114 which is removably supported on runners 116 which are rigidly fixed to each lateral side of the case 12. Accordingly, the chute array 175 is removably mounted to the case 12 and may be easily inserted or withdrawn therefrom for cleaning and is maintained in position in the case by means of the stop 110 and spacer 112 already described.

The outlets 102 of the chutes terminate within a receiving chamber 118 for containing a tray 98 and glasses 96. The chamber 118 has an entrance 120 positioned immediately below the door 14 and through which an operator may insert the tray 98. The array 175 collectively constitutes delivery means usable with the invention for directing ice from the gate 26 downwardly therethrough and into the drinking containers 96 positioned below the outlets 102 of the chutes.

While the already described dispensing apparatus functions entirely satisfactorily as an ice dispenser, if desired it can also be equipped to serve as a combined ice and water dispenser. Referring now to FIG. 4, a water manifold 122 has a male fitting 124 which engages female fitting 126 in water-tight relationship therewith, the fitting 126 being the outlet of water valve 128 which is connected to a water source. The manifold 122 branches at its intersection with fitting 124 and has first and second sections 130 and 132, respectively, which extends from the rear of the case 12 forwardly, passing between the outlets 102 of the chutes of adjacent rows of chutes before merging in a third section 134 at the front of the case. A plurality of nozzles 136 extends outwardly from the manifold sections 130 and 132 and terminates over the open top of each container 96 to discharge water from the nozzle 136 directly downwardly into the container, a nozzle being provided to fill each of the drinking containers 96 on the tray 98. Each of these nozzles 136 (FIG. 5), which are substantially identical, has a first segment 137 and an angled segment 138 adjacent the end of the nozzle to further aim the water more directly downwardly into the glass to assure that water enters the container 96. The segment 138 is aimed to strike the center of the open topped container 96 which is of average height. Accordingly, when a relatively higher container 139 is used, the water will still comfortably clear the edge of the container and enter the container 139.

The valve 128 is provided with a forwardly extending actuating lever 140 which extends into the chamber 118, being positioned to be urged rearwardly by the leading edge 97 of the tray 98 as it is slid into the receiving chamber 118, thereby pushing the actuating lever rearwardly to an on position and causing water flow from the valve and into the manifold 122 for discharge into the containers 96. A platform 142 is located at the bottom of the chamber 118 and is pivotally mounted at 144. As the containers on the tray 98 fill with water, their weight increases, causing the platform 142 to move downwardly to position 150 overcoming the upward force of spring 146 which is attached between the platform 142 and fixed extending flange 148. When the platform 142 reaches the position 150, the tray is below lever 140 and the lever 140 is no longer contacted by the tray 98 and accordingly returns forwardly to an off position, turning off the water flow through the valve 128. A removable drain pan 154 is located at the bottom of the case 12 and has an opening 155 which communicates with drain 156.

Although the embodiment 10 has been shown as having a specific number of elongated members positioned above a specific number of upright chutes 94, it should be understood that the number of elongated members may be increased or decreased along with the number of chutes to fill a larger or smaller number of drinking containers. In addition, while a particular water manifold has been disclosed for the filling of the twenty containers shown herein, it should also be understood that other water manifolds having additional sections may be utilized to fill glasses when there are additional numbers of rows of containers, and that all such modifications are within the purview of the invention.

In operation, the operator first swings open the front door 14 about its hinges 15 to gain access to the interior cavity 16 of the case 12. The lid 28 is removed from the hopper 18 and a supply of ice 20 is inserted therein. This supply of ice may take the form of a solid block of ice, may be a plurality of chunks of ice, or alternatively crushed ice may be used. The gate means 26 is ordinarily in a closed position 76 (FIG. 3) wherein the troughs or elongated members have their ice-retaining webs 64 positioned in the closed position 76, wherein the webs of the individual elongated members cooperate with one another to form a barrier across the discharge opening 22 of the hopper 18. In such orientation, little or no ice can pass downwardly from the hopper and it is retained in the hopper by the ice-retaining webs of the elongated members.

When it is desired to dispense ice into the containers 96 of tray 98, the tray keeps the containers in a predetermined orientation compatible with the arrangement of the chute outlets 102. The tray 98 is slid into the entrance 120 of the receiving chamber 118 and is supported on the platform 142 with the leading edge 97 of the tray in contact with the actuating lever 140 of the valve 128. As the tray is urged toward the valve, the actuating lever 140 is moved rearwardly from an off to an on position, causing water to flow from the water supply through the valve 128, the female fitting 126, the male fitting 124, and along manifold sections 130 and 132 to cause emission of water from the plurality of nozzles 136, as best illustrated in FIG. 5, resulting in filling of the containers with water. When the containers are filled, their increased weight is adequate to cause the platform 142 to overcome the upwardly directed spring force of spring 146 and drop to position 150, causing the actuating level 140 to return to the off position and turn off the water flow to the water manifold 122. The precise details of the construction of the water manifold, the valve 128 and the platform 142 are disclosed in U.S. Pat. No. 3,580,304 entitled "Glass Filler," and will not be described further herein.

The operator may dispense ice into the glasses simultaneously with the dispensing of water, or afterward. When it is desired to dispense the ice, the operator grasps the crank 92 and swings it through approximately a 90° arc, causing rotation of each of the spur gears 82–91 through approximately the same arc and in the directions indicated by the arrows of FIG. 2. As the spur gears rotate, the elongated members rotate about their longitudinal axes 62 through approximately 90° from the closed position 76 shown in FIG. 3 to the discharge position 78 of FIGS. 2 and 6. Each two adjacent elongated members, such as members 44 and 46, 47 and 48, 50 and 52, 54 and 56, and 58 and 60, cooperate with each other, swinging their longitudinal edges 66 and 68 in arc about their axes 62 and toward one another as shown in FIG. 6, causing the longitudinal edges to engage and dig into the ice supply 20 to break and remove pieces from the ice. When the elongated members are in the discharge position 78 illustrated in FIG. 2, longitudinal slots 80 are defined between the adjacent semicircular ice-retaining webs 64, and the ice broken from the supply 20 drops downwardly through the slots 80. The ice passing through the gate 26 enters the plurality of chutes 94 positioned therebelow and falls down the untapered portions 105, gaining velocity and striking tapered portion 172 of the chute 94. The ice striking the portion 172 of the chute ricochets inwardly and strikes the chute again or collides with other ice to further break the ice into smaller particles and to slow its speed of descent as it leaves the outlet 102 of the chute and drops into the container 96 therebelow. This lowered speed of descent results in minimal splashing from the drinking container 96 when already filled with water.

After discharging the ice, the operator returns the crank 92 to its starting position, thereby rotating the spur gears 82–91 and swinging the elongated members back to a closed position 76 wherein further flow from the hopper 18 is obstructed by the barrier formed by the cooperating elongated members. If additional ice is desired, the operator repeats the process of swinging the handle 92 for a further discharge from the hopper.

The outwardly tapered hopper 18 assures that ice within the hopper does not readily adhere to the interior walls of the hopper, but instead drops downwardly to provide continual engagement between the ice supply 20 and the elongated members. By keeping the ice in constant contact with the elongated members, the weight of the ice is continually applied to the members and as the ice-breaking means on the members engages and contacts the ice, it readily removes and chips the ice supply 20.

While the preferred embodiment of the present invention has been described, it should be understood that various changes, adaptations and modifications may be made therein without departing from the spirit of the invention and the scope of the appended claims.

I claim:

1. A dispensing apparatus usable with an ice supply for filling a plurality of drinking containers positioned in adjacent, predetermined locations on a tray, comprising:

a storage hopper capable of storing the supply of ice in its interior and having a discharge opening at the bottom of said hopper for discharging ice from within the hopper interior;

gate means positioned in blocking relationship with said discharge opening of said hopper, said gate means including a multiplicity of adjacent, rigid, elongated members;

each said elongated member having a longitudinal axis and being disposed in side-by-side relationship with the remaining elongated members with said longitudinal axes of said members being parallel to one another and spaced apart from one another, the distances between said axes being fixed;

each said elongated member including an ice retaining web and each said web having a pair of spaced apart longitudinal cutting edges;

each said elongated member being mounted for rotation about its said longitudinal axis and swingable between a closed position, wherein said longitudinal edges of said adjacent elongated members are positioned closely adjacent each other and said webs define a barrier across said discharge opening obstructing ice flow past said members, and a discharge position wherein said longitudinal edges of said elongated member are spaced from said longitudinal edges of the adjacent said elongated members to define discharge slots between adjacent elongated members with the distance separating said longitudinal edges of adjacent elongated members being greater when said elongated members are in discharge position than when in closed position whereby ice may pass through said discharge slots of said gate means; wherein each said longitudinal cutting edge of said elongated member is positioned to swing within said hopper and against the ice supply during rotation of said elongated members so as to loosen ice from the ice supply to cause ice discharge from said hopper and through said gate means gate operating means mechanically connected to said elongated members to simultaneously rotate all said elongated members about their axes between said closed and discharge positions; and delivery means positioned below said gate means and positionable above a tray and plurality of drinking containers on the tray, said delivery means including a plurality of generally upright chutes, each of said chutes having an inlet below said gate means to receive ice from said hopper and an outlet terminating over a container.

2. A dispensing apparatus usable with an ice supply for filling a plurality of drinking containers positioned in adjacent, predetermined locations on a tray, comprising:

a storage hopper for containment of the ice supply and having a discharge opening at the bottom thereof for discharging ice from said hopper;

gate means adjacent said hopper and positioned in blocking relationship with said discharge opening in said hopper, said gate means including a plurality of rigid, elongated, arcuate cross-section troughs with each trough having a central longitudinal axis, a pair of spaced apart, longitudinal cutting edges parallel to said longitudinal axis, and a web portion, said elongated troughs being positioned in side-by-side parallel relationship with one another, having longitudinal axes spaced from one another, and said troughs being mounted for rotation about their longitudinal axes to rotate through an arc between a closed position, wherein the web portions of said troughs confront the hopper and any ice supply therein and wherein the said longitudinal edges of adjacent troughs are closely adjacent each other and said troughs cooperate to obstruct said discharge opening of said hopper, and a discharge position, wherein said web portion of each trough confronts the web portion of an adjacent trough to define a generally longitudinal gap between adjacent troughs through which ice may be discharged from said hopper downwardly through said gate means; wherein said each longitudinal cutting edge of said elongated troughs is positioned to swing within said hopper and against the ice supply during rotation of said elongated troughs so as to loosen ice from the ice supply to cause ice discharge from said hopper and through said gate means gate operating means mechanically connected to said troughs to simultaneously rotate all said troughs about their longitudinal axes between said closed and discharge positions; and delivery means positioned below said gate means and positioned above a tray and plurality of drinking containers on the tray, said delivery means including a plurality of generally upright chutes, each of said chutes having an inlet below said gate means to receive ice from said hopper and an outlet terminating over a container.

3. The dispensing apparatus of claim 2 wherein each said elongated trough has a reinforcing band extending across the trough and connected to the longitudinal edges of the trough to reinforce said edges for breaking of ice.

4. The dispensing apparatus of claim 2 wherein said chutes have tapered sidewalls with the outlet of each chute being substantially smaller in cross-sectional area than its inlet, thereby permitting said tapered sidewalls to intercept falling ice thereon to break the ice into smaller pieces and through such interception to also reduce the downward speed of the ice as it falls into the drinking containers.

5. The dispensing apparatus of claim 4 and further including a water manifold positioned below said gate means and having a plurality of nozzles extending from said manifold and directed downwardly toward the drinking containers, said manifold being positioned between the outlets of said chutes and said nozzles being clear of said outlets of said chutes to avoid obstructing downward ice flow from said chutes.

* * * * *